US007125346B2

(12) United States Patent
Ohama et al.

(10) Patent No.: US 7,125,346 B2
(45) Date of Patent: Oct. 24, 2006

(54) SOLID GOLF BALL

(75) Inventors: Keiji Ohama, Kobe (JP); Koichi Fujisawa, Kobe (JP); Kazuhiko Isogawa, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/037,070

(22) Filed: Jan. 19, 2005

(65) Prior Publication Data

US 2005/0202902 A1 Sep. 15, 2005

(30) Foreign Application Priority Data

Feb. 5, 2004 (JP) ..... 2004-029213

(51) Int. Cl.
*A63B 37/12* (2006.01)

(52) U.S. Cl. ..... 473/377

(58) Field of Classification Search ..... 473/377
See application file for complete search history.

(56) References Cited

U.S. PATENT DOCUMENTS 6,394,915 B1 * 5/2002 Nesbitt ..... 473/378
6,642,314 B1 11/2003 Sone et al.
2003/0032501 A1 2/2003 Sakagami et al.

FOREIGN PATENT DOCUMENTS

| | | | |
|---|---|---|---|
| GB | 2376637 | A | 12/2002 |
| JP | 2001-149502 | A | 6/2001 |
| JP | 2002-293996 | A | 10/2002 |
| JP | 2002-355338 | A | 12/2002 |
| JP | 2003-33447 | A | 2/2003 |

* cited by examiner

*Primary Examiner*—Raeann Gorden
(74) *Attorney, Agent, or Firm*—Birch, Stewart, Kolasch & Birch, LLP

(57) ABSTRACT

The present invention provides a solid golf ball, of which flight performance is improved, while maintaining good durability and good shot feel. The present invention relates to a solid golf ball comprising at least one layer of a core, and at least one layer of a cover formed on the core, wherein the core is formed from a rubber composition comprising a base rubber, a co-crosslinking agent, an organic peroxide and an organic sulfur compound, the base rubber comprises a polybutadiene synthesized using rare-earth element-containing catalyst, and the organic sulfur compound comprises a polysulfide compound having bromo group.

9 Claims, No Drawings

SOLID GOLF BALL

FIELD OF THE INVENTION

The present invention relates to a golf ball. More particularly, it relates to a solid golf ball, of which flight performance is improved, while maintaining good durability and good shot feel.

BACKGROUND OF THE INVENTION

In golf balls commercially selling, there are solid golf balls such as two-piece golf ball, three-piece golf ball and the like, and thread wound golf balls. Recently, the solid golf balls, of which flight distance can be improved while maintaining soft and good shot feel at the time of hitting as good as the conventional thread wound golf ball, generally occupy the greater part of the golf ball market. In the solid golf ball, many techniques for further improving the performance thereof, such as technique for improving the rebound characteristics, technique for varying hardness distribution, have been suggested, and the solid golf balls having good shot feel while maintaining excellent flight performance have been provided (Japanese Patent Kokai Publication Nos. 149502/2001, 293996/2002, 355338/2002, 33447/2003 and the like).

In Japanese Patent Kokai Publication No. 149502/2001, a golf ball comprising vulcanized molded article of rubber composition as a structural element is disclosed, the rubber composition mainly comprises a base rubber containing 10 to 100 mass % of polybutadiene containing a cis-1,4 bond of not less than 90%, and the polybutadiene has a 5 mass % toluene solution viscosity at 25° C., η (mPa·s) of not less than 200 and a ratio (Mw/Mn) of weight average molecular weight (Mw) to number average molecular weight (Mn) of 2.0 to 4.0.

In Japanese Patent Kokai Publication No. 293996/2002, a rubber composition containing (a) 50 parts to 100 parts by weight of modified polybutadiene rubber having a 1,4-cis bond content of 80 mol % to 100 mol % and a 1,2-vinyl bond content of 0 mol % to 2 mol %, which is modified with an alkoxysilyl group-containing compound, (b) 50 part to 0 parts by weight of diene rubber other than the above-mentioned component (a) (wherein the total amount of component (a) and component (b) is 100 parts by weight), (c) 10 parts to 50 parts by weight of a crosslinkable monomer, (d) 5 parts to 80 parts by weight of an inorganic filler, and (e) 0.1 part to 10 parts by weight of an organic peroxide, is disclosed.

In Japanese Patent Kokai Publication No. 355338/2002, a golf ball comprising a hot-molded product of a rubber composition comprising, based on 100 parts by weight of a base rubber composed of (a) 20 to 100 wt % of a polybutadiene having a cis-1,4 content of at least 60% and a 1,2-vinyl content of at most 2%, having a 5 mass % toluene solution viscosity η at 25° C. of not less than 600 mPa·s, and satisfying the following relationship:

$$10\times B+5 \leqq A \leqq 10\times B+60$$

wherein A is Mooney viscosity ($ML_{1+4}$(100° C.)) of the polybutadiene and B is a ratio (Mw/Mn) of weight average molecular weight (Mw) to number average molecular weight (Mn) of the polybutadiene, in combination with (b) 0 to 80 wt % of a diene rubber other than the component (a), (c) 10 to 60 parts by weight of an unsaturated carboxylic acid and a metal salt thereof or both, (d) 0.1 to 5 parts by weight of an organosulfur compound, (e) 5 to 80 parts by weight of an inorganic filler, and (f) 0.1 to 5 parts by weight of an organic peroxide:

wherein the hot-molded product has a difference in JISC hardness between the center and surface thereof of more than 15 and up to 40 JIS-C hardness units, is disclosed.

In Japanese Patent Kokai Publication No. 333447/2003, a solid golf ball comprising a core containing at least one layer, and a cover containing at least one layer and covering the core, wherein the at least one layer of the core is molded by vulcanizing a rubber composition including: (a) a base rubber, (b) a co-crosslinking agent, (c) an organic peroxide, and (d) a polysulfide compound represented by the following formula:

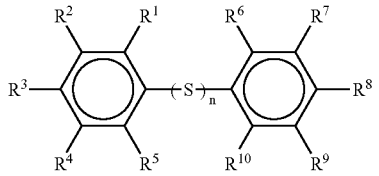

(where at least one of $R^1$ to $R^5$ and at least one of $R^6$ to $R^{10}$ are each Br, and n is an integer of not less than 2), is disclosed.

However, in the resulting golf balls described above, sufficient performances have not been accomplished, and therefore golf balls having further improved performance have been required. In addition, it has been problem in the golf balls that the durability and rebound characteristics are degraded by softening the core such that the difference between the surface hardness and center hardness is increased because of soft and good shot feel.

OBJECTS OF THE INVENTION

A main object of the present invention is to provide a solid golf ball, of which flight performance is improved, while maintaining good durability and good shot feel.

According to the present invention, the object described above has been accomplished by providing a core formed from rubber composition comprising a base rubber, a co-crosslinking agent, an organic peroxide and an organic sulfur compound; using the base rubber comprising a polybutadiene synthesized using rare-earth element-containing catalyst; and using the organic sulfur compound comprising polysulfide compound having bromo group, thereby providing a solid golf ball, of which flight performance is improved, while maintaining good durability and good shot feel.

SUMMARY OF THE INVENTION

The present invention relates to a solid golf ball comprising at least one layer of a core, and at least one layer of a cover formed on the core, wherein the core is formed from a rubber composition comprising a base rubber, a co-crosslinking agent, an organic peroxide and an organic sulfur compound, the base rubber comprises a polybutadiene synthesized using rare-earth element-containing catalyst, and the organic sulfur compound comprises a polysulfide compound having bromo group.

In order to put the present invention into a more suitable practical application, it is preferable that:

the core have a deformation amount when applying from an initial load of 98 N to a final load of 1275 N of 2.0 to 8.0 mm;

the rare-earth element-containing catalyst be a neodymium-containing catalyst;

the polybutadiene synthesized using rare-earth element-containing catalyst be comprised in an amount of 20 to 100 parts by weight, based on 100 parts by weight of the base rubber; and the polysulfide compound having bromo group be comprised in an amount of 0.01 to 5 parts by weight, based on 100 parts by weight of the base rubber.

In the golf ball, when the rebound characteristics of the core are improved, the velocity of the resulting golf ball at the time of hitting is high, and the flight performance is improved. It is also very important to increase the difference between a center hardness and surface hardness of the core, thereby soft and good shot feel of the resulting golf ball can be effectively obtained. In addition, the deformation amount is high, which increases the launch angle and the spin amount is small, and accordingly the flight performance is improved. However, the durability is degraded by increasing the deformation amount. That is, in the prior art described above, the rebound characteristics are improved to improve the flight performance by modifying the base rubber and using the organic sulfur compound. However, since it is not considered to adjust the hardness in the core to a proper range, it is problem to degrade the other performance.

In order to solve the problem, the present inventors have studied the components of the rubber composition for the core and performance of the resulting golf ball. As a result, it was apparent that, (1) the surface hardness of the core is higher than that of the prior art core;

(2) the rebound characteristics are improved, although they are degraded by increasing hardness difference in the prior art core; and (3) the durability is improved too much as compared with the case of increasing the hardness difference by the conventional method;

by using the rubber composition for the core comprising a base rubber, a co-crosslinking agent, an organic peroxide and an organic sulfur compound, of which the base rubber comprises a polybutadiene synthesized using rare-earth element-containing catalyst, and the organic sulfur compound comprises a polysulfide compound having bromo group. The (3) is mainly accomplished by comprising a polybutadiene synthesized using rare-earth element-containing catalyst in the base rubber and the (1) and (2) are mainly accomplished by comprising a polysulfide compound having bromo group in the organic sulfur compound. Therefore, in the present invention, a solid golf ball, of which flight performance is improved, while maintaining good durability and good shot feel, can be accomplished.

DETAILED DESCRIPTION OF THE PREFERRED EMBODIMENTS

The golf ball of the present invention will be explained in detail hereinafter. The solid golf ball of the present invention comprises at least one layer of a core, and at least one layer of a cover formed on the core. The core used for the golf ball of the present invention is obtained by vulcanizing and press-molding the rubber composition. The rubber composition comprises a base rubber, a co-crosslinking agent, an organic peroxide, an organic sulfur compound, filler, an antioxidant and the like.

In the golf ball of the present invention, it is required for the base rubber in the rubber composition to comprise a polybutadiene synthesized using rare-earth element-containing catalyst. It is desired for the polybutadiene to have a Mooney viscosity of not less than 50 to less than 65 $ML_{1+4}$(100° C.), preferably 50 to 62 $ML_{1+4}$(100° C.), more preferably 50 to 60 $ML_{1+4}$(100° C.), most preferably 52 to 60 $ML_{1+4}$(100° C.). When the Mooney viscosity is lower than 50 $ML_{1+4}$(100° C.), the workability when producing is good, but the rebound characteristics are poor. On the other hand, when the Mooney viscosity is not less than 65 $ML_{1+4}$(100° C.), the rebound characteristics are good, but the workability when producing is poor.

It is desired for the polybutadiene to have a ratio (Mw/Mn) of weight average molecular weight (Mw) to number average molecular weight (Mn) of 2.0 to 6.0, preferably 2.0 to 4.0, more preferably 2.5 to 3.5. When the ratio (Mw/Mn) is smaller than 2.0, the rebound characteristics are good, but the workability when producing is poor. On the other hand, when the ratio (Mw/Mn) is larger than 6.0, the processability is good, but the rebound characteristics are poor. It is desired for the polybutadiene to have a weight average molecular weight (Mw) of $50\times10^4$ to $70\times10^4$, preferably $54\times10^4$ to $68\times10^4$, more preferably $56\times10^4$ to $67\times10^4$. When the Mw is lower than $50\times10^4$, the rebound characteristics are not sufficiently obtained. On the other hand, when the Mw is higher than $70\times10^4$, the rebound characteristics are good, but the workability when producing is poor. It is desired for the polybutadiene to have a weight average molecular weight (Mn) of $15\times10^4$ to $40\times10^4$, preferably $18\times10^4$ to $35\times10^4$, more preferably $20\times10^4$ to $32\times10^4$ When the Mn is lower than $15\times10^4$, the rebound characteristics are not sufficiently obtained. On the other hand, when the Mn is higher than $40\times10^4$, the rebound characteristics are good, but the workability when producing is poor.

In the rubber composition for golf ball of the present invention, it is desired for the amount of the polybutadiene to be within the range of 20 to 100 parts by weight, preferably 30 to 100 parts by weight, more preferably 50 to 100 parts by weight, based on 100 parts by weight of the base rubber. When the amount is smaller than 20 parts by weight, the technical effects accomplished by the presence of the polybutadiene are not sufficiently obtained, and it is impossible to improve the rebound characteristics and to increase the hardness difference, which degrades the flight performance.

As described above, in the rubber composition for the core of the present invention, the base rubber may be formed from the polybutadiene alone, but the polybutadiene may be compounded in combination with synthesis rubber, particularly the other polybutadiene rubber other than the polybutadiene described above, which has been conventionally used for solid golf balls. The base rubber may optionally contain natural rubber, polyisoprene rubber, styrene-butadiene rubber, ethylene-propylene-diene rubber (EPDM) and the like.

The term "Mooney viscosity" as used herein refers to an indication of a viscosity which is measured using a Mooney viscometer as a kind of rotational plastometer. The Mooney viscosity is typically used for measuring a viscosity of a rubber composition in the field of rubber industry. The Mooney viscosity is determined by closely putting a rubber composition in a gap between a cylindrical dice and a rotor positioned at the center of the dice, and then measuring a torque occurring when rotating a rotor at a testing temperature of 100° C., for a preheating time of 1 minute, at the number of revolutions of 2 rpm, for the time of revolution of 4 minutes. The Mooney viscosity is expressed in $ML_{1+4}$(100° C.), wherein M represents a Mooney viscosity, L represents a large rotor (L type) as a shape of the rotor, (1+4) represents that a preheating time is 1 minute and a time of revolution of the rotor is 4 minutes, and 100° C. represents a testing temperature. The measurement is generally conducted according to JIS K 6300.

Examples of the rare-earth element-containing catalysts used to synthesize the polybutadiene in the present invention, which may be well known such catalysts include, for example, a combination of a lanthanide series rare-earth element compound, an organoaluminum compound, an alumoxane, halogen-containing compound and optionally a Lewis base. Preferred is lanthanide series rare-earth element compound, and particularly preferred is neodymium-containing catalyst using neodymium compound.

Examples of the lanthanide series rare-earth element compounds include halides, carboxylates, alcoholates, thioalcoholates and amides of rare-earth metals having atomic numbers of 57 to 71. It is preferable to use neodymium containing catalyst using neodymium compound as the lanthanide series rare-earth element compound among them, because polybutadiene having high 1,4-cis bond content and low 1,2-vinyl bond content is obtained at excellent polymerization activity.

Examples of the organoaluminum compounds include those having the general formula:

$$Al\ R^1R^2R^3$$

wherein $R^1$, $R^2$ and $R^3$, which may be the same or different one another, are independently selected from hydrogen or hydrocarbon group having 1 to 8 carbon atoms.

Examples alumoxanes, which are obtained by contacting organoaluminum compound with a condensation agent, include linear alumoxanes having the general formula:

$$(\text{—}Al\ (R^4)O\text{—})_m$$

wherein $R^4$ is hydrocarbon group having 1 to 10 carbon atoms and the hydrocarbon group may be substituted with halogen atom and/or alkoxy group; or cyclic alumoxanes. Examples of R4 include methyl, ethyl, propyl, isobutyl and the like, and preferred is methyl. Examples of the organoaluminum compounds used as a raw material of the alumoxane include trialkyl aluminum, such as trimethyl aluminum, triethyl aluminum, triisobutyl aluminum, and mixtures thereof. The alumoxane using the mixture of trimethyl aluminum and tributyl aluminum as a raw material can be suitably used. Examples of the condensation agents include typically water, optionally those, such as absorbed water of inorganic matter or diol, with which the trialkyl aluminum can condensation react. The alumoxane association complexes described in Fine Chemical, 23, (9), 5(1994), J. Am. Chem. Soc., 115, 4971 (1993), J. Am. Chem. Soc., 117, 6465 (1995), can be also used for this purpose.

Examples of the halogen-containing compounds include aluminum halides of the general formula:

$$Al\ X_nR^5_{3-n}$$

wherein X is a halogen, $R^5$ is alkyl, aryl or aralkyl group having 1 to 20 carbon atoms, and n is 1, 1.5, 2 or 3; strontium halide, such as $Me_3SrCl$, $Me_2SrCl_2$, $MeSrHCl_2$, $MeSrCl_3$ (Me=methyl): metal halides, such as silicon tetrachloride, tin tetrachloride, titanium tetrachloride, and the like.

The Lewis bases serve to convert the lanthanide series rare-earth element compounds into complexes. Acetylacetone, ketone, alcohols and the like may be suitably used for this purpose.

When butadiene is polymerized in the present of the rare-earth element-containing catalyst using the lanthanide series rare-earth element compound, the molar ratio of butadiene to lanthanide series rare-earth element compound is within the range of $5\times10^2$ to $5\times10^6$, preferably $1.0\times10^3$ to $1.0\times10^5$. The molar ratio of organoaluminum compound to lanthanide series rare-earth element compound is within the range of 5 to 500, preferably 10 to 300. The molar ratio of halogen-containing compound to lanthanide series rare-earth element compound is within the range of at least 0.5, preferably 1 to 20. The molar ratio of Lewis base to lanthanide series rare-earth element compound is within the range of 1 to 10, preferably 1.5 to 5.

In the polymerization of butadiene, the rare-earth element-containing catalysts may be used as solution in an organic solvent such as n-hexane, cyclohexane, n-heptane, toluene, xylene, benzene and the like, or carried on suitable carriers such as silica, magnesia and magnesium chloride. The polymerization of butadiene may be carried out in a solvent, or bulk polymerization without a solvent. The polymerization temperature is within the range of −30 to 150° C., and the polymerization pressure may vary depending on other conditions.

In the rubber composition for the core of the present invention, examples of the co-crosslinking agents include α, β-unsaturated carboxylic acids having 3 to 8 carbon atoms (such as acrylic acid, methacrylic acid, etc.) or mono or divalent metal salts (such as zinc or magnesium salts) thereof. Preferred are zinc acrylate and zinc methacrylate. The amount of the co-crosslinking agent is preferably from 10 to 50 parts by weight, more preferably from 10 to 45 parts, most preferably from 15 to 45 parts by weight, based on 100 parts by weight of the base rubber. When the amount of the co-crosslinking agent is smaller than 10 parts by weight, the core is not sufficiently crosslinked and is too soft, which degrades the rebound characteristics and the durability of the resulting golf ball. On the other hand, when the amount of the co-crosslinking agent is larger than 50 parts by weight, the degree of the crosslinking is too high and the core is too hard, and the shot feel of the resulting golf ball is hard and poor.

Examples of the organic peroxides, which act as crosslinking agent or curing agent, include for example dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.1 to 3.0 parts by weight, preferably from 0.3 to 3.0 parts by weight, more preferably from 0.5 to 2.5 parts by weight, based on 100 parts by weight of the base rubber. When the amount of the organic peroxide is smaller than 0.1 parts by weight, crosslinking reaction does not sufficiently occur. On the other hand, when the amount of the organic peroxide is larger than 3.0 parts by weight, the core is too hard, but the rebound characteristics are not sufficiently obtained. In addition, the shot feel of the resulting golf ball is poor.

In the rubber composition for the core of the present invention, it is required for the organic sulfur compound to comprise a polysulfide compound having bromo group. Examples of the polysulfide compounds are not limited thereto, but include polysulfide compounds represented by the following formula:

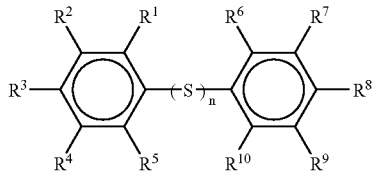

wherein $R_1$ to $R_5$ and $R_6$ to $R_{10}$ independently represent a hydrogen or bromo group, at least one of $R_1$ to $R_5$ and at least one of $R_6$ to $R_{10}$ are bromo groups, preferably three or more of $R_1$ to $R_5$ and three or more of $R_6$ to $R_{10}$ are bromo groups, more preferably all of $R_1$ to $R_{10}$ are bromo groups, and n is integer of not less than 2, preferably n is 2.

When the number of bromine atoms substituted in the phenyl group is many, the rebound characteristics of the resulting golf ball are excellent and they can be assured when hit at low head speed. When monosulfide having one sulfur atom between two phenyl groups is used, as compared with disulfide having the same level of deformation amount as the monosulfide, the rebound characteristics are poor, and they can not be sufficiently assured particularly when hit at low head speed. The polysulfide compound used in the present invention may be polysulfide compound having two or more sulfur atoms, but preferred is disulfide compound in view of the easiness of synthesis, availability and cost.

Therefore, in the polysulfide compounds represented by the above formula, preferred are bis(bromophenyl) disulfide, bis(dibromophenyl)disulfide, bis (tribromophenyl)disulfide, bis(tetrabromophenyl) disulfide, bis(pentabromophenyl)disulfide and the like, more preferred are polysulfide compounds having six or more bromo groups, and most preferred is bis(pentabromophenyl) disulfide, which all hydrogen atoms in the phenyl group are substituted with bromo group.

The amount of the organic sulfur compound is from 0.01 to 5.0 parts by weight, preferably from 0.05 to 4.0 parts by weight, more preferably from 0.1 to 3.0 parts by weight, based on 100 parts by weight of the base rubber. When the amount of the organic sulfur compound is smaller than 0.01 parts by weight, the technical effects of improving the rebound characteristics by the presence of the organic sulfur compound are not sufficiently obtained. On the other hand, when the amount of the organic sulfur compound is larger than 5.0 parts by weight, the deformation amount is large, which degrades the rebound characteristics.

In the rubber composition for the core of the present invention, the organic sulfur compound may be comprised of the polysulfide compound having bromo group alone, but the organic sulfur compound may be compounded in combination with the other polysulfide compound, that is, the organic sulfur compound, which has been conventionally used for solid golf balls, such as polysulfide compound having no bromo group.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is preferably from 1 to 50 parts by weight, more preferably from 3 to 45 parts by weight, based on 100 parts by weight of the base rubber. When the amount of the filler is smaller than 1 part by weight, it is difficult to adjust the weight of the resulting golf ball. On the other hand, when the amount of the filler is larger than 50 parts by weight, the weight ratio of the rubber component in the core is small, and the rebound characteristics of the resulting golf ball are degraded too much.

The rubber composition for the core of the golf ball of the present invention can contain other components, which have been conventionally used for preparing the core of solid golf balls, such as antioxidant. If used, the amount of the antioxidant is preferably 0.5 to 5 parts by weight, more preferably 0.7 to 4 parts by weight, based on 100 parts by weight of the base rubber.

The core used for the golf ball of the present invention can be obtained by vulcanizing and press-molding the above rubber composition under applied heat in a mold at 140 to 180° C. and 2.8 to 11.8 MPa for 10 to 60 minutes. In the vulcanization condition, the vulcanization temperature is preferably as high as possible because of large hardness distribution, for example, the core is preferably vulcanized at a temperature of not less than 160° C. in case of using dicumyl peroxide as an organic peroxide.

In the golf ball of the present invention, it is desired for the core to have a diameter of 32.8 to 40.8 mm, preferably 33.6 to 40.0 mm. When the diameter of the core is smaller than 32.8 mm, the rebound characteristics are degraded, which reduces the flight distance. On the other hand, when the diameter of the core is larger than 40.8 mm, the thickness of the cover is too small, and the durability is degraded.

In the golf ball of the present invention, it is desired for the core to have a deformation amount when applying from an initial load of 98 N to a final load of 1275 N of 2.0 to 8.0 mm, preferably 2.2 to 7.5 mm, more preferably 2.8 to 6.2 mm. When the deformation amount of the core is smaller than 2.0 mm, the core itself is too hard, and the shot feel of the resulting golf ball is poor without depending on the hardness difference in the core. On the other hand, when the deformation amount is larger than 8.0 mm, the core itself is too soft, and the rebound characteristics and the durability of the resulting golf ball are degraded.

In the golf ball of the present invention, it is desired for the core to have a hardness difference (b−a) in JIS-C hardness between the center hardness (a) and surface hardness (b) of not less than 20, preferably 23 to 50, more preferably 28 to 50. When the hardness difference is smaller than 20, the deformation amount of the core is small, and the shot feel of the resulting golf ball is poor. In addition, the flight performance of the resulting golf ball is degraded. On the other hand, when the hardness difference is larger than 50, the durability of the resulting golf ball is degraded.

In the golf ball of the present invention, it is desired for the core to have the center hardness in JIS-C hardness of less than 65, preferably 35 to 60, more preferably 40 to 55. When the center hardness is not less than 65, the core is too hard, and the shot feel of the resulting golf ball is degraded.

In the golf ball of the present invention, it is desired for the core to have the surface hardness in JIS-C hardness of 60 to 90, preferably 65 to 90. When the hardness is lower than 60, the core is too soft, and the rebound characteristics and durability of the resulting golf ball are degraded. On the other hand, when the hardness is higher than 90, the core is too hard, and the shot feel is hard and poor without depending on the hardness difference in the core. The term "a surface hardness of the core" as used herein refers to the hardness, which is determined by measuring a hardness at the surface of the core prepared by press molding and vulcanizing as described above, that is, at the surface of the outmost layer in the whole core, whether the core has single-layered structure or multi-layered structure. The term "a center hardness of the core" as used herein refers to the hardness, which is obtained by cutting the core into two equal parts and then measuring a hardness at the center point in section.

The cover is then covered on the core obtained from the rubber composition. In the golf ball of the present invention, the cover may have single-layer structure or multi-layer structure that has two or more layers. The cover of the golf ball of the present invention is preferably formed from thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover of the present invention, the above ionomer resin may be used alone, but the ionomer resin may be used in combination with at least one of the thermoplastic elastomer, diene-based block copolymer and the like. Examples of the thermoplastic elastomers, which are commercially available, include polyamide-based thermoplastic elastomer, which is commercially available from Atofina Japan Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based thermoplastic elastomer, which is commercially available from BASF Japan Co., Ltd. under the trade name of "Elastollan" (such as "Elastollan ET880"); styrene-based thermoplastic elastomer, which are commercially available from Mitsubishi Chemical Co., Ltd. under the trade name of "Rabalon" (such as "Rabalon T3339C"); and the like.

The diene-based block copolymer is a block copolymer or partially hydrogenated block copolymer having double bond derived from conjugated diene compound. The base block copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene-based block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene-based block copolymers which are commercially available include the diene-based block copolymers, which are commercially available from Daicel Chemical Industries, Ltd. under the trade name of "Epofriend" (such as "Epofriend A1010"), the diene-based block copolymers, which are commercially available from Kuraray Co., Ltd. under the trade name of "Septon" (such as "Septon HG-252") and the like.

The amount of the thermoplastic elastomer or diene-based block copolymer is 0 to 60 parts by weight, preferably 10 to 40 parts by weight, based on 100 parts by weight of the base resin for the cover. When the amount is larger than 60 parts by weight, the cover is too soft and the rebound characteristics are degraded, or the compatibility with the ionomer resin is degraded and the durability is degraded.

The composition for the cover used in the present invention may optionally contain fillers, which are the same as used for the core, pigments such as titanium dioxide, and the other additives (such as a dispersant, an antioxidant, a UV absorber, a photostabilizer and a fluorescent agent or a fluorescent brightener, etc., in addition to the resin component.

A method of covering on the core with the cover is not specifically limited, but may be a conventional method. For example, there can be used a method comprising molding the cover composition into a semi-spherical half-shell in advance, covering the core with the two half-shells, followed by press molding at 130 to 170° C. for 1 to 5 minutes, or a method comprising injection molding the cover composition directly on the core, which is covered with the cover, to cover it.

In the golf ball of the present invention, the cover has a thickness of 1.0 to 5.0 mm, preferably 1.4 to 4.6 mm, more preferably 1.4 to 2.5 mm. When the thickness is smaller than 1.0 mm, the cover is too thin, and the durability is degraded. In addition, the rebound characteristics are degraded. On the other hand, when the thickness is larger than 5.0 mm, the shot feel is degraded.

At the time of molding the cover, many depressions called "dimples" are formed on the surface of the golf ball. Furthermore, paint finishing or marking with a stamp may be optionally provided after the cover is molded for commercial purposes. The golf ball of the present invention is formed, so that it has a diameter of not less than 42.67 mm (preferably 42.67 to 42.82 mm) and a weight of not more than 45.93 g, in accordance with the regulations for golf balls.

EXAMPLES

The following Examples and Comparative Examples further illustrate the present invention in detail but are not to be construed to limit the scope of the present invention.

Production of Cores

The rubber compositions for cores having formulations shown in Table 1 (Examples) and Table 2 (Comparative Examples) were mixed, and then vulcanized by press-molding at the vulcanization condition shown in the same Tables to obtain spherical cores having a diameter shown in Table 4 (Examples) and Table 5 (Comparative Examples). The deformation amount and hardness distribution of the resulting core were measured, and the results are shown in the same Tables. The test methods are described later.

TABLE 1

| Core composition | Example No. 1 | 2 | 3 | 4 | 5 | 6 |
|---|---|---|---|---|---|---|
| BR-11 *1 | — | — | — | 50 | — | — |
| BR-730 *2 | 100 | 100 | 100 | 50 | 100 | 100 |
| Zinc acrylate | 27 | 29 | 30 | 28 | 32 | 20 |
| Zinc oxide | 10 | 10 | 10 | 10 | 10 | 10 |
| Dicumyl peroxide | 1.0 | 1.0 | 1.0 | 1.0 | 1.0 | 1.0 |
| Barium sulfate *3 | Proper amount | Proper amount | Proper amount | Proper amount | Proper amount | Proper amount |
| PCTP *4 | — | — | — | — | — | — |
| DPDS *4 | — | — | — | — | — | — |
| PBDS *4 | 0.5 | 1.0 | 2.0 | 0.3 | 1.0 | 1.0 |
| Vulcanization condition | | | | | | |
| Temperature (° C.) | 165 | 165 | 165 | 165 | 170 | 165 |
| Time (min) | 20 | 20 | 20 | 20 | 20 | 20 |

TABLE 2

| Core composition | Comparative Example No. 1 | 2 | 3 | 4 | 5 |
|---|---|---|---|---|---|
| BR-11 *1 | 100 | — | — | 100 | 100 |
| BR-730 *2 | — | 100 | 100 | — | — |
| Zinc acrylate | 29 | 30 | — | 26 | 28 |
| Zinc oxide | 10 | 10 | 10 | 10 | 10 |
| Dicumyl peroxide | 1.0 | 1.0 | 1.0 | 1.0 | 1.0 |
| Barium sulfate *3 | Proper amount | Proper amount | Proper amount | Proper amount | Proper amount |
| PCTP *4 | — | — | 0.5 | — | — |
| DPDS *4 | 0.5 | 0.5 | — | — | 0.5 |
| PBDS *4 | — | — | — | 1.0 | — |
| Vulcanization condition | | | | | |
| Temperature (° C.) | 165 | 165 | 165 | 165 | 175 |
| Time (min) | 20 | 20 | 20 | 20 | 20 |

*1: Polybutadiene synthesized using nickel-containing catalyst, commercially available from JSR Co., Ltd.
*2: Polybutadiene synthesized using neodymium-containing catalyst, commercially available from JSR Co., Ltd.
*3: The amount of barium sulfate was adjusted to a proper amount such that the weight of the resulting golf ball was 45.4 g.
*4: PCTP: pentachlorothiophenol DPDS: diphenyldisulfide PBDS: bis (pentabromophenyl) disulfide

Preparation of Cover Compositions

The formulation materials for the cover shown in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder. The JIS-C hardness was measured using a sample of a stack of the three or more heat and press molded sheets having a thickness of about 2 mm from the resulting cover compositions, which had been stored at 23° C. for 2 weeks. The results are shown in Tables 3 to 5 as the cover hardness.

TABLE 3

| Cover composition | A | B | C |
|---|---|---|---|
| Hi-milan 1605 *5 | 50 | 30 | 40 |
| Surlyn 9945 *6 | 40 | 30 | 40 |
| Rabalon T3339C *7 | 10 | 40 | 20 |
| Titanium dioxide | 2 | 2 | 2 |
| Barium sulfate | 2 | 2 | 2 |
| Hardness (JIS-C) | 89 | 70 | 85 |

*5: Hi-milan 1605 (trade name), ethylene-methacrylic acid copolymer ionomer resin obtained by neutralizing with sodium ion, manufactured by Du Pont-Mitsui Polychemicals Co., Ltd.
*6: Surlyn 9945 (trade name), ethylene-methacrylic acid copolymer ionomer resin obtained by neutralizing with zinc ion, manufactured by Du Pont Co.
*7: Rabalon T3339C (trade name), styrene-based thermoplastic elastomer, manufactured by Mitsubishi Chemical Co., Ltd.

TABLE 4

| | Example No. 1 | 2 | 3 | 4 | 5 | 6 |
|---|---|---|---|---|---|---|
| (Core) | | | | | | |
| Diameter (mm) | 39.6 | 39.6 | 37.6 | 39.6 | 39.6 | 36.4 |
| Deformation amount (mm) | 3.8 | 3.6 | 4.2 | 3.2 | 2.8 | 6.2 |
| Hardness (JIS-C) | | | | | | |
| Center hardness (a) | 60 | 60 | 55 | 64 | 63 | 49 |
| Surface hardness (b) | 83 | 86 | 85 | 86 | 87 | 74 |
| Hardness difference (b − a) | 23 | 26 | 30 | 22 | 24 | 25 |
| (Inner cover) | | | | | | |
| Composition | — | — | B | — | — | C |
| Hardness (JIS-C) | — | — | 70 | — | — | 85 |
| Thickness (mm) | — | — | 1.0 | — | — | 1.6 |
| (Outer cover) | | | | | | |
| Composition | A | A | A | A | A | A |
| Hardness (JIS-C) | 89 | 89 | 89 | 89 | 89 | 89 |
| Thickness (mm) | 1.6 | 1.6 | 1.6 | 1.6 | 1.6 | 1.6 |

TABLE 5

| | Comparative Example No. 1 | 2 | 3 | 4 | 5 |
|---|---|---|---|---|---|
| (Core) | | | | | |
| Diameter (mm) | 39.6 | 39.6 | 39.6 | 37.6 | 39.6 |
| Deformation amount (mm) | 3.8 | 3.6 | 4.0 | 4.2 | 4.0 |

TABLE 5-continued

| | Comparative Example No. | | | | |
|---|---|---|---|---|---|
| | 1 | 2 | 3 | 4 | 5 |
| | Hardness (JIS-C) | | | | |
| Center hardness (a) | 61 | 63 | 61 | 60 | 60 |
| Surface hardness (b) | 79 | 80 | 77 | 80 | 81 |
| Hardness difference (b − a) | 18 | 17 | 16 | 20 | 21 |
| | (Inner cover) | | | | |
| Composition | — | — | — | B | — |
| Hardness (JIS-C) | — | — | — | 70 | — |
| Thickness (mm) | — | — | — | 1.0 | — |
| | (Outer cover) | | | | |
| Composition | A | A | A | A | A |
| Hardness (JIS-C) | 89 | 89 | 89 | 89 | 89 |
| Thickness (mm) | 1.6 | 1.6 | 1.6 | 1.6 | 1.6 |

Examples 1, 2, 4, 5 and Comparative Examples 1 to 3 and 5

The cover composition was injection molded to obtain semi-spherical half-shell for the cover. The core obtained as described above was covered with the two semi-spherical half-shells for the cover and then press-molded in the mold at 150° C. for 2 minutes to form a cover layer having a thickness of 1.6 mm, and then clear paint was coated on the surface of the cover layer to obtain a two-piece golf ball having a diameter of 42.8 mm and a weight of 45.4 g.

Examples 3, 5 and Comparative Example 4

The cover layer having a thickness shown in Table 4 (Examples) and Table 5 (Comparative Examples) was formed as described in Examples 1, 2, 4, 5 and Comparative Examples 1 to 3 and 5, except that the step of forming the cover layer was repeated two times, to obtain a three-piece golf ball having a diameter of 42.8 mm and a weight of 45.4 g.

With respect to the resulting golf balls, the coefficient of restitution, durability, flight distance and shot feel were measured or evaluated. The results are shown in Table 6 (Examples) and Table 7 (Comparative Examples). The test methods are as follows.

TEST METHODS (1) Deformation Amount of the Core

The deformation amount was determined by measuring the deformation amount when applying from an initial load of 98 N to a final load of 1275 N on the core.

(2) Hardness

The JIS-C hardness was measured by using an automatic rubber hardness tester (type P1), which is commercially available from Kobunshi Keiki Co., Ltd., with a JIS-C hardness meter according to JIS-K6301.

(i) Core Hardness

The surface hardness of the core was determined by measuring a JIS-C hardness at the surface of the resulting core. The center hardness of the core was determined by cutting the core into two equal parts and then measuring a JIS-C hardness at the center point in section.

(ii) Cover Hardness

The cover hardness was determined by measuring a JIS-C hardness, using a sample of a stack of the three or more heat and press molded sheets having a thickness of about 2 mm from the cover composition, which had been stored at 23° C. for 2 weeks.

(3) Coefficient of Restitution

A cylindrical aluminum projectile having a weight of 200 g was struck at a speed of 40 m/sec against a golf ball, and the velocity of the projectile and the golf ball after the strike was measured. The coefficient of resilience of the golf ball was calculated from the velocity and the weight of both the projectile and the golf ball before and after the strike. The measurement was conducted by using 12 golf balls for each sample (n=12), with the mean value being taken as the coefficient of resilience of each ball and expressed as an index, with the value of the index in Comparative Example 1 being taken as 1. A higher index corresponded to a higher rebound characteristic, and thus a good result.

(4) Durability

After a No. 1 wood club (a driver, W#1) having metal head was mounted to a swing robot manufactured by Golf Laboratory Co., a golf ball was hit at a head speed of 45 m/sec to strike against an impact board, repeatedly. The durability is the number of strike until the cover of the golf ball cracks, and is indicated by an index when that of Comparative Example 1 is 100. The larger the number is, the better durability the golf ball has.

(5) Flight Distance

After a No. 1 wood club (a driver, W#1; "XXIO" loft angle=11 degrees, R shaft, manufactured by Sumitomo Rubber Industries, Ltd.) having metal head was mounted to a swing robot manufactured by Golf Laboratory Co. and the resulting golf ball was hit at a head speed of 40 m/sec, the flight distance was measured. As the flight distance, total that is a distance to the stop point of the hit golf ball was measured. The measurement was conducted 12 times for each golf ball (n=12), and the average is shown as the result of the golf ball.

(6) Shot Feel

The shot feel of the golf ball is evaluated by 10 golfers according to a practical hitting test using a No. 1 wood club (W#1, a driver). The evaluation criteria are as follows.

Evaluation Criteria

○○: Not less than 8 golfers out of 10 golfers felt that the golf ball has good shot feel such that the impact force at the time of hitting is small and the rebound characteristics are good.

○: Six to 7 golfers out of 10 golfers felt that the golf ball has good shot feel such that the impact force at the time of hitting is small and the rebound characteristics are good.

Δ: Four to 5 golfers out of 10 golfers felt that the golf ball has good shot feel such that the impact force at the time of hitting is small and the rebound characteristics are good.

x: Not more than 3 golfers out of 10 golfers felt that the golf ball has good shot feel such that the impact force at the time of hitting is small and the rebound characteristics are good.

Test Results

TABLE 6

| Test item | Example No. 1 | 2 | 3 | 4 | 5 | 6 |
|---|---|---|---|---|---|---|
| Coefficient of restitution | 1.02 | 1.03 | 1.03 | 1.04 | 1.05 | 1.03 |
| Durability | 110 | 115 | 120 | 125 | 140 | 125 |
| Flight distance (m) | 178.5 | 179 | 180 | 181 | 182 | 179.5 |
| Shot feel | ○○ | ○○ | ○○ | ○ | ○ | ○○ |

TABLE 7

| Test item | Comparative Example No. 1 | 2 | 3 | 4 | 5 |
|---|---|---|---|---|---|
| Coefficient of restitution | 1.0 | 1.02 | 1.01 | 1.02 | 0.99 |
| Durability | 100 | 110 | 100 | 110 | 90 |
| Flight distance (m) | 176 | 177.5 | 176 | 178 | 176.5 |
| Shot feel | ○ | Δ | Δ | ○ | ○ |

As is apparent from Tables 6 and 7, the golf balls of Examples 1 to 6 of the present invention, when compared with the golf balls of Comparative Examples 1 to 5, had, large coefficient of restitution, excellent controllability and good shot feel.

On the other hand, in the golf ball of Comparative Example 1, since the polybutadiene synthesized using nickel-containing catalyst is only used as the base rubber of the rubber composition for the core, the resulting golf ball has slightly good shot feel, but the coefficient of restitution is small. In addition, since the polysulfide compound having no bromo group is only used as the organic sulfur compound, the surface hardness of the core is low, and the hardness difference between the surface hardness and center hardness is small. In the golf ball of Comparative Example 2, since the polybutadiene synthesized using rare-earth element-containing catalyst is only used as the base rubber of the rubber composition for the core, the resulting golf ball has large coefficient of restitution. In addition, since the polysulfide compound having no bromo group is only used as the organic sulfur compound, the surface hardness of the core is low, and the hardness difference between the surface hardness and center hardness is small.

In the golf ball of Comparative Example 3, since the polybutadiene synthesized using rare-earth element-containing catalyst is used as the base rubber of the rubber composition for the core, the resulting golf ball has large coefficient of restitution. In addition, since pentachlorothiophenol having no bromo group is only used as the organic sulfur compound, the surface hardness of the core is low, and the hardness difference between the surface hardness and center hardness is small. In the golf ball of Comparative Example 4, since the polybutadiene synthesized using nickel-containing catalyst is only used as the base rubber of the rubber composition for the core, the resulting golf ball has slightly good shot feel, but the coefficient of restitution is small. In addition, since the polysulfide compound having no bromo group is only used as the organic sulfur compound, the hardness difference between the surface hardness and center hardness is small and the coefficient of restitution is small.

In the golf ball of Comparative Example 5, since the polybutadiene synthesized using nickel-containing catalyst is only used as the base rubber of the rubber composition for the core, the resulting golf ball has slightly good shot feel, but the durability is degraded. In addition, since the polysulfide compound having no bromo group is only used as the organic sulfur compound, the coefficient of restitution is small.

What is claimed is:

1. A solid golf ball comprising at least one layer of a core, and at least one layer of a cover formed on the core, wherein the core is formed from a rubber composition comprising a base rubber, a co-crosslinking agent, an organic peroxide and an organic sulfur compound, the base rubber comprises a polybutadiene synthesized using rare-earth element-containing catalyst in an amount of 100 parts by weight, based on 100 parts by weight of the base rubber, and the organic sulfur compound comprises a polysulfide compound having at least one bromo group, and the core has a center hardness in JIS-C hardness of 35 to 60, a surface hardness in JIS-C hardness of 60 to 90 and a hardness difference (b-a) in JIS-C hardness between a center hardness (a) and a surface hardness (b) of not less than 20.

2. The solid golf ball according to claim 1, wherein the core has a deformation amount when applying from an initial load of 98 N to a final load of 1275 N of 2.0 to 8.0 mm.

3. The solid golf ball according to claim 1, wherein the rare-earth element-containing catalyst is a neodymium-containing catalyst.

4. The solid golf ball according to claim 1, wherein the polysulfide compound having at least one bromo group is comprised in an amount of 0.01 to 5 parts by weight, based on 100 parts by weight of the base rubber.

5. The solid golf ball according to claim 1, wherein the polysulfide compound having at least one bromo group is represented by the following formula:

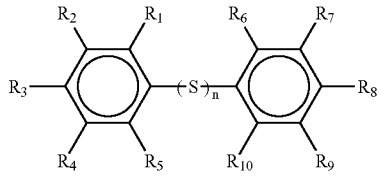

wherein $R_1$ to $R_5$ and $R_6$ to $R_{10}$ independently represent a hydrogen or bromo group, at least one of $R_1$ to $R_5$ and at least one of $R_6$ to $R_{10}$ are bromo groups, and n is not less than 2.

6. The solid golf ball according to claim 5, wherein in the polysulfide compound three or more of $R_1$ to $R_5$ and three or more of $R_6$ to $R_{10}$ are bromo groups.

7. The solid golf ball according to claim 5, wherein in the polysulfide compound all of $R_1$ to $R_{10}$ are bromo groups and n is 2.

8. The solid golf ball according to claim 1, wherein the core has the center hardness in JIS-C hardness of 40 to 55, the surface hardness in JIS-C hardness of 65 to 90 and the hardness difference (b−a) in JIS-C hardness between the center hardness (a) and the surface hardness (b) is 23 to 50.

9. The solid golf ball according to claim 1, wherein the hardness difference (b−a) in JIS-C hardness between the center hardness (a) and the surface hardness (b) is 28 to 50.

* * * * *